United States Patent [19]

Geeson

[11] 3,977,340

[45] Aug. 31, 1976

[54] DIAPHRAGM CLOSED CANS

[75] Inventor: Robert Ernest Geeson, Pinner, England

[73] Assignee: Metal Box Limited, Reading, England

[22] Filed: Apr. 8, 1975

[21] Appl. No.: 566,524

Related U.S. Application Data

[62] Division of Ser. No. 287,332, Sept. 8, 1972, abandoned.

[30] Foreign Application Priority Data

Sept. 27, 1971 United Kingdom ..... 44919/71

[52] U.S. Cl. ..... 113/1 E; 113/18 C; 113/30; 113/120 K; 113/120 Y

[51] Int. Cl.[2] ..... B21D 51/26; B21D 51/34

[58] Field of Search ..... 113/1 E, 1 F, 16, 18 C, 113/18 D, 30, 120 K, 120 Y, 120 XY, 121 A, 121 AB, 121 C

[56] References Cited

UNITED STATES PATENTS

| | | | |
|---|---|---|---|
| 277,920 | 5/1883 | Norton | 113/120 Y |
| 388,288 | 8/1888 | Knapp | 113/120 Y |
| 388,289 | 8/1888 | Knapp | 113/120 Y |
| 941,085 | 11/1909 | Marthinson | 113/30 |
| 1,590,754 | 6/1926 | Hulbert | 113/30 |
| 1,803,616 | 5/1931 | Hothersall | 113/120 Y |
| 2,578,731 | 12/1951 | Nordquist et al. | 113/30 |
| 2,700,355 | 1/1955 | Erb | 113/120 Y |

FOREIGN PATENTS OR APPLICATIONS

| | | |
|---|---|---|
| 491,671 | 9/1938 | United Kingdom |

*Primary Examiner*—Lowell A. Larson
*Assistant Examiner*—E. M. Combs
*Attorney, Agent, or Firm*—Diller, Brown, Ramik & Wight

[57] ABSTRACT

In a can one end of which is closed by a diaphragm the diaphragm is positioned against a peripherally extending flattened bead which is formed in the can body and extends into the body and the diaphragm is clinched against the flattened bead by overturning and inturning of the portion of the body which extends from the flattened bead to the mouth of the body.

8 Claims, 32 Drawing Figures

DIAPHRAGM CLOSED CANS

This is a division of application Ser. No. 287,332, filed Sept. 8, 1972, now abandoned.

BACKGROUND OF THE INVENTION

1. Field of the invention.

This invention relates to cans and in particular to a can of the kind comprising a body having an open top closed by a diaphragm.

2. Description of the Prior Art

Cans of the kind referred to above are sometimes used to contain products such as dried milk powder, instant coffee, ground coffee, and other products which will tolerate only relatively small increases in moisture content without losing their fresh condition and the diaphragms used with such cans are usually of paper, foil or plastics material, or combinations of such materials, secured to the cans by, for example, an adhesive which may be a heat-sealable adhesive preapplied to the diaphragms or to the cans. This kind of can has the disadvantage that the thin film of adhesive sometimes has insufficient bond strength and insufficient thickness to form an effective seal particularly in the region of the side seam of the can body. Further, during heatsealing adhesive tends to be squeezed out and to adhere to the lid which covers the diaphragm-closed end of the can and this sometimes results in the diaphragm being ruptured when the lid is removed.

It has also been proposed mechanically to secure the diaphragm, without the use of an adhesive, to a separate ring which is fitted in the end of a can and connected thereto by a double end seam, the can being closed by a lid of the kind known as a lever lid. Cans of this kind are more expensive because an additional component, the above mentioned ring, is required, and there is a disadvantage in that the diaphragm does not have a flat form, thereby creating risks of rupturing, particularly if creases are formed. Furthermore, this method reduces the sealing efficiency of the double end seam.

It is an object of the present invention to provide a can having an open top closed by a diaphragm and which overcomes the disadvantages of cans of the kinds just referred to.

SUMMARY

According to the invention there is provided a can comprising a body one end of which is closed by a diaphragm extending thereacross and secured in position by a peripherally extending marginal portion thereof clinched between peripherally extending portions of the body bent into the body.

According to another aspect thereof the invention provides a method of closing an open end of a can body, which method includes the steps of bending the body at a position adjacent to but spaced from said open end to form a peripherally extending internal bead, disposing a diaphragm on the side of the bead facing said open end, and clinching the diaphragm against the bead by bending against the diaphragm the end portion of the body extending from the bead to said open end.

BRIEF DESCRIPTION OF THE DRAWINGS

In the drawings like references indicate like or similar parts.

DESCRIPTION OF THE PREFERRED EMBODIMENTS

Figure 1:
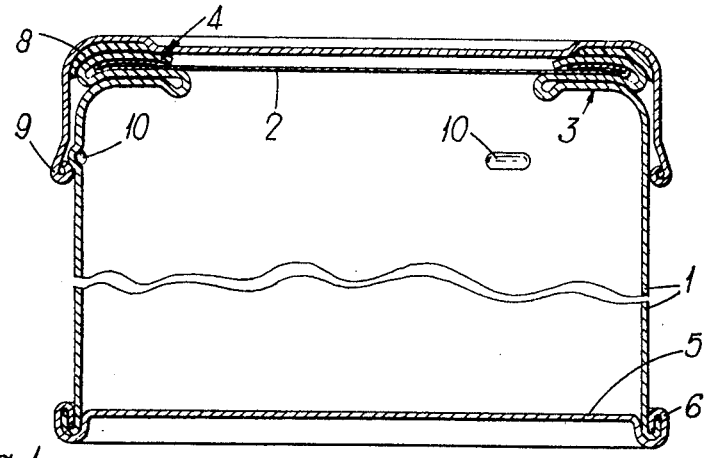
FIG. 1 is a longitudinal section through a can according to the invention.

Referring to FIG. 1, the can comprises a body 1 having an open top closed by a diaphragm 2 made of any suitable material such as paper, metal foil, plastics film or composite materials laminated from combinations of any two or more of such materials. The diaphragm extends across the open top and is secured in position by a peripherally extending marginal portion thereof which is clinched between peripherally extending portions 3, 4 of the body which are bent into the body. As shown in FIG. 1 the opposite end of the body is closed by an end closure 5 of known kind which, in known manner, is double-seamed, as at 6, to the body 1. The contents of the can are inserted into the can after the diaphragm has been secured in position and before the end closure 5 is seamed to the body. A slip on cover 7, of known kind, preferably including a gasket 8 of sealing material covers the diaphragm and is, in known manner, retained in position by an inturned bead 9 which is engaged beneath pips 10, for example three equispaced pips, which extend outwards from the body at positions adjacent to the clinched portions 3, 4 and which are located between the clinched portions and the end of the body opposite that closed by the diaphragm.

Figure 2:
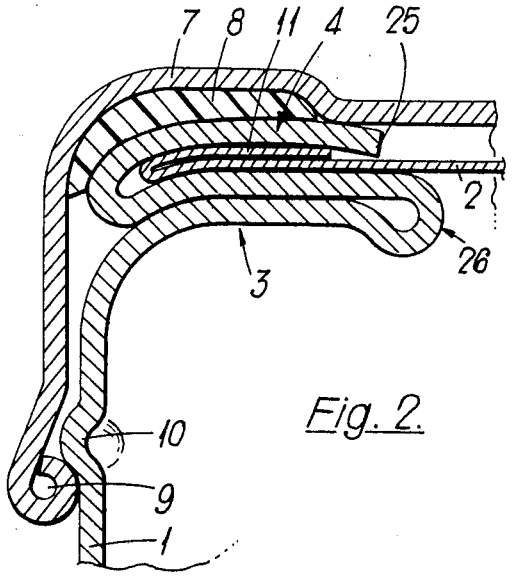
FIG. 2 illustrates, to an enlarged scale, a part of a modified form of the can of FIG. 1.
Figure 3:
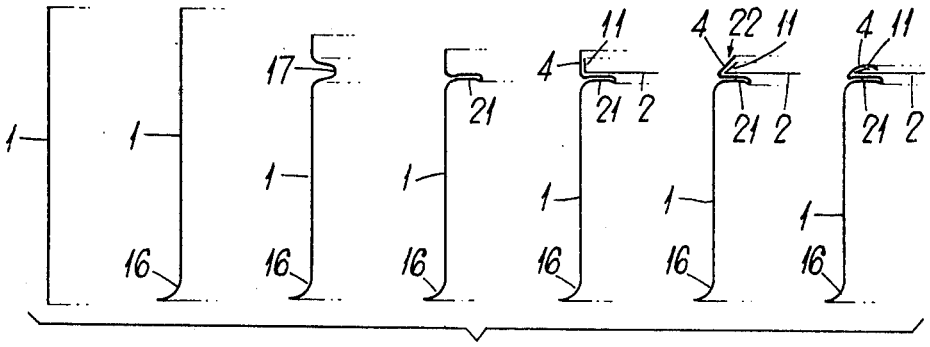
FIG. 3 is a diagram illustrating the method of forming the can of FIG. 2, FIG. 4 diagrammatically illustrates mechanism for securing a diaphragm to a can body.
Figure 4:
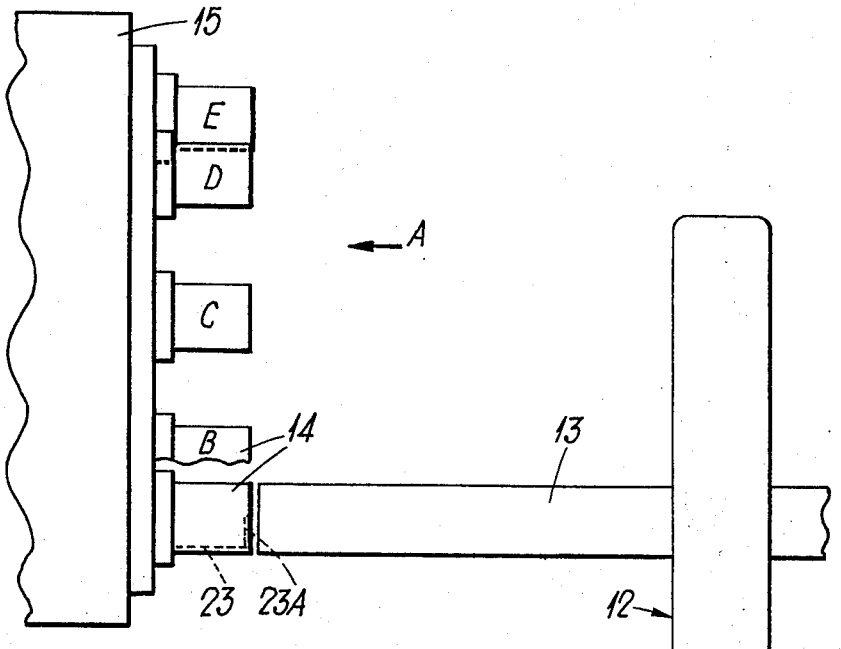
FIG. 4, FIGS. 6 to 10 illustrate tooling for carrying out the method of FIG. 3.
Figure 5:
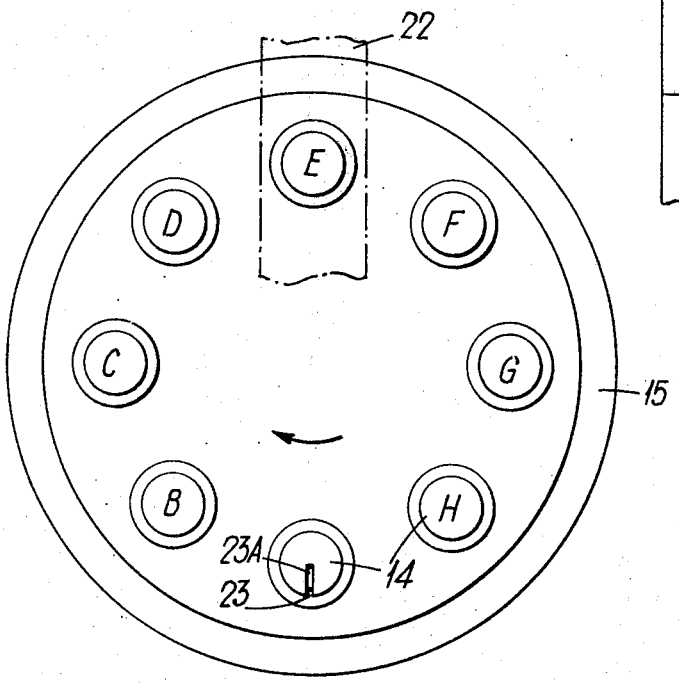
FIG. 5 is a view of FIG. 4 looking in the direction of arrow A.
Figure 6:
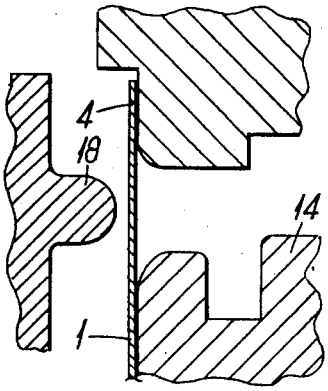
Figure 7:
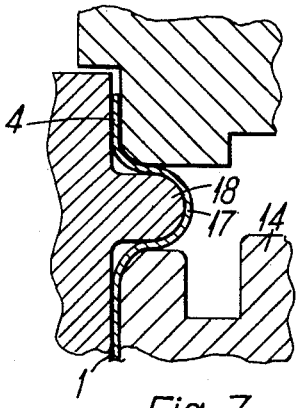
Figure 8:
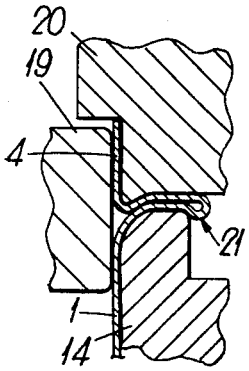
Figure 9:
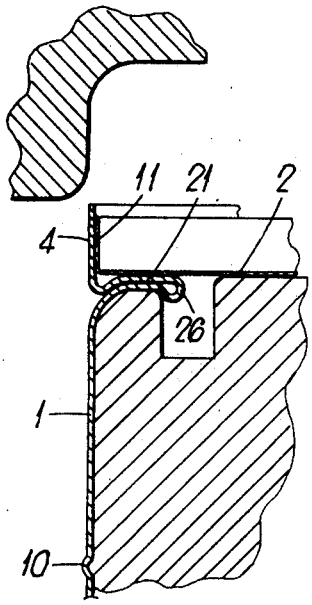
Figure 10:
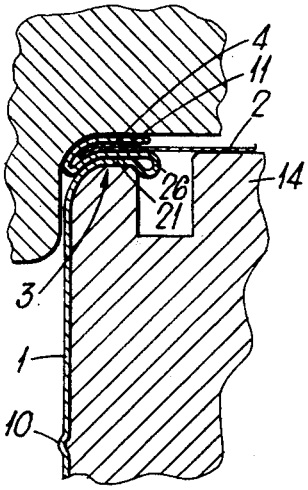
Figure 11:
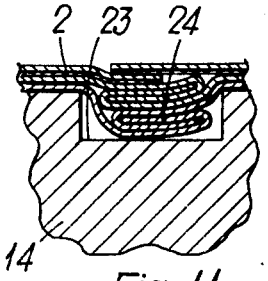
FIG. 11 is a sectional elevation of a dolly which is an element of the tooling.
Figure 11A:
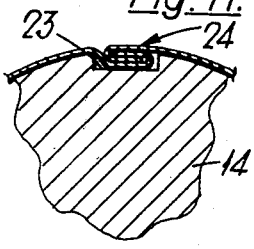
FIG. 11A is a plan, in section, of FIG. 11.

In the embodiment illustrated in FIG. 2 the marginal portion of the diaphragm 2 includes a portion 11 of the diaphragm which is overturned upon the diaphragm. This method of securing the diaphragm of FIG. 2 is illustrated in FIG. 3. The can body 1 is formed as a cylinder, in known manner, by a body-making machine indicated generally at 12, FIG. 4, and issues from the mandrel extension 13 to be received on a dolly 14 movable with a rotatable turret 15 which is indexed through successive positions thereof at which successive operations are performed on a can body. A flange 16, which together with the end closure 5 is to form the seam 6, is formed at position B, FIG. 5, at which position the pips 10 can also be formed, and at position C a bead 17, FIGS. 3 and 7, is formed by a tool 18, FIGS. 6 and 7, to extend into the body. The bead 17 is collapsed at position D, as illustrated in FIGS. 3 and 8, by tools 19, 20, FIG. 8, to become flattened as at 21. At position E a diaphragm is blanked from a web 22, FIG. 5, by any suitable means, not shown, is formed into a cup, and is positioned with the bottom of the cup against the flattened bead, FIGS. 3 and 9. At position F a first clinching operation 22, FIG. 3, is performed involving inturning towards the flattened bead 21 of the end portion 4 of the body which extends from the bead to the open end of the body. At position G a second clinching operation is performed, FIGS. 3 and 10. During clinching the marginal portion of the diaphragm, formed by the walls of the cup, is inturned flat against the body of the diaphragm as formed by the bottom of the cup. The dollies 14 are each provided with an axially extending slot 23, FIGS. 4 and 11A, in which the longitudinal seam 24, FIG. 11 A, of the can body 1 is located as the can passes over the dolly from the mandrel extension 13. An extension 23A, FIGS. 4 and 5, of the slot 23 extends radially inwards through the lip of the dolly and facilitates the flattening of the bead 17 which, as will be understood, has a greater thickness of material where it is formed in the can body seam. The raw edge, 25 FIG. 2, is protected by the folded portion 26 of the bead against causing harm to the user of the can following opening thereof by the removal of a portion of the diaphragm. The can with the diaphragm secured in position is ejected at position H.

The method of closing the open end of the can shown in FIG. 1 is similar to that just described except that the diaphragm 2 is a flat disc which does not have a marginal portion 11 folded thereon during clinching by the end portion 4 of the body 1.

Figure 12:
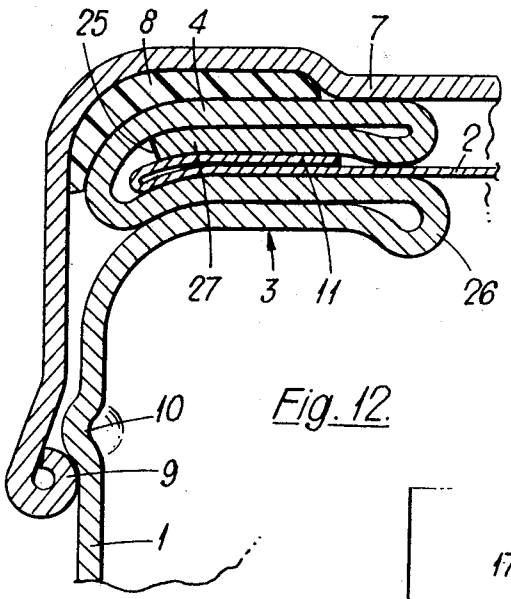
FIG. 12 illustrates, to an enlarged scale, a part of a further alternative form of the can.
Figure 13:
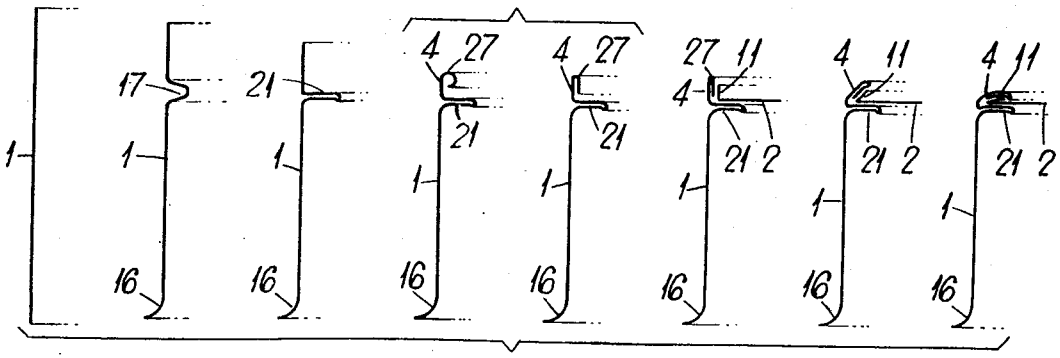
FIG. 13 is a diagram illustrating the steps of the method of forming the can of FIG. 12.

In the alternative arrangement of FIG. 12 the marginal portion 11 of the diaphragm is folded upon the diaphragm as described above and in addition the inturned end portion 4 of the body 1 includes a portion 27 which is inturned upon itself so that the raw edge 25 is hidden from the user. This is the preferred embodiment of the invention. With this embodiment the preparation of the body 1 for the securing of the diaphragm is effected at successive positions at the first of which the flange 16 and bead 17 are simultaneously formed, at the second position the bead 17 is flattened, at the third position a three-quarter curl, FIG. 13 is formed from the marginal portion 27 and is flattened against the end portion 4.

Figure 14:
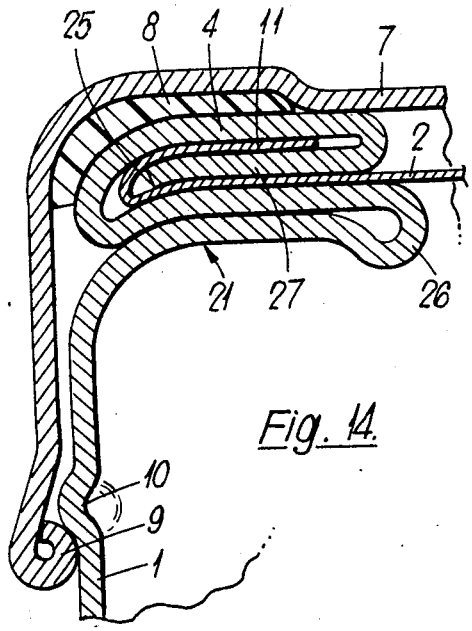
FIG. 14 illustrates, to an enlarged scale, a part of another alternative form of the can.
Figure 15:
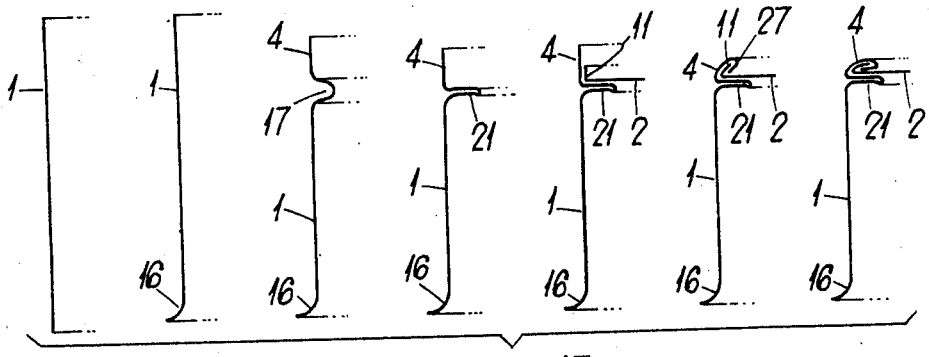
FIG. 15 is a diagram illustrating the steps of the method of forming the can of FIG. 14.

The embodiment of FIG. 14 is similar to that of FIG. 12 but differs therefrom in that the marginal portion 11 of the diaphragm is gripped between the peripherally extending inturned portions 4 and 27 of the body. The method of securing the diaphragm in this insuance consists of forming the flange 16 at position B, forming the bead 17 at position C, flattening bead 17 at position D, forming a cup-like diaphragm and positioning it on the flattened bead at position E, and at position F forming the three-quarter curl 27 which is thereafter flattened at the clinching position G.

Figure 16:
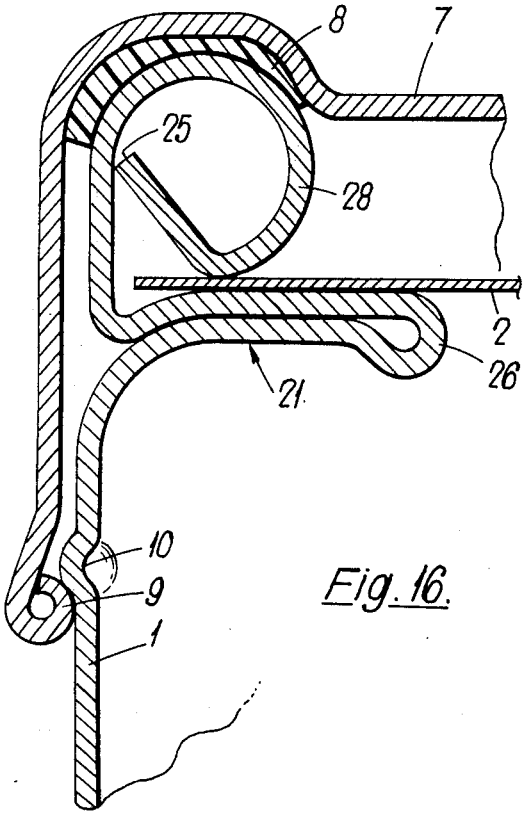
FIG. 16 illustrates, to an enlarged scale, a part of another alternative form of the can.
Figure 17:
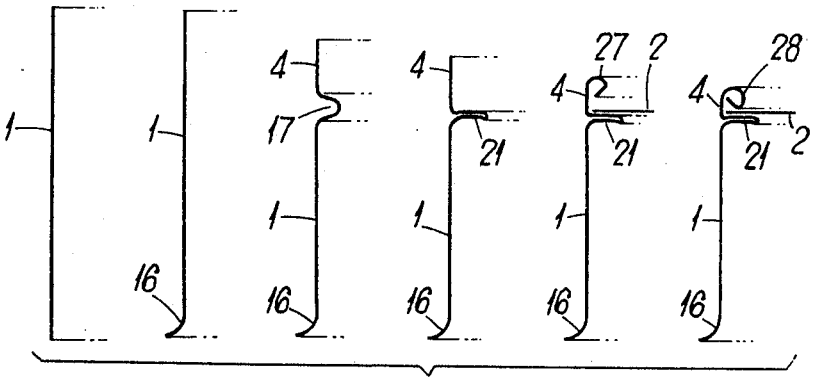
FIG. 17 is a diagram illustrating the steps of the method of forming the can of FIG. 16, FIG. 18 to 22 illustrate tooling for carrying out the method of FIG. 17.
Figure 18:
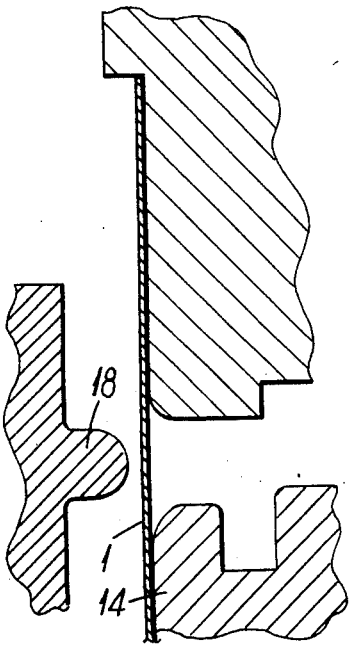
Figure 19:
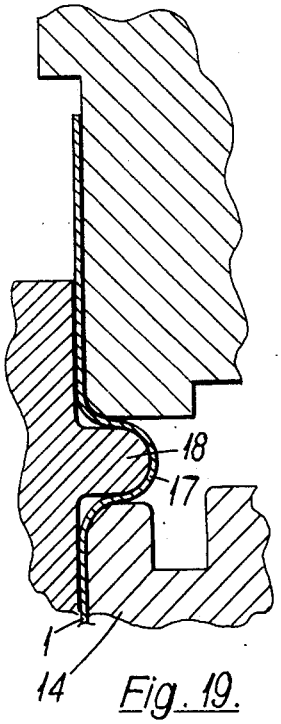
Figure 20:
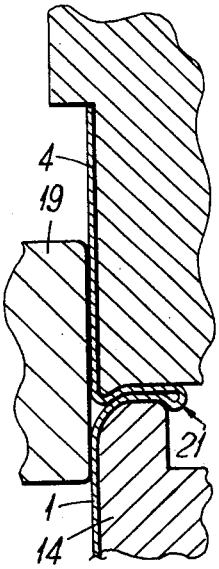
Figure 21:
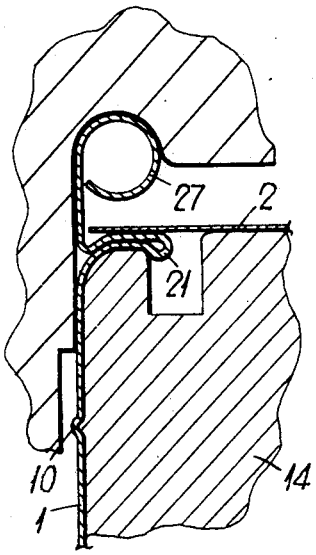
Figure 22:
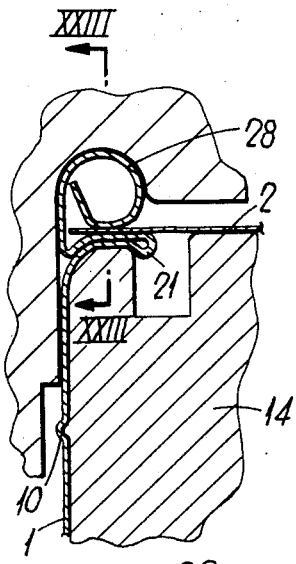
Figure 23:
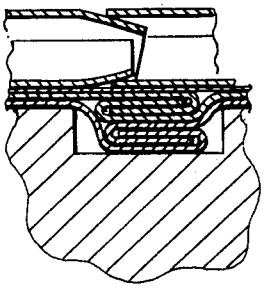
FIG. 23 is a section on line XXIII—XXIII, FIG. 22, but taken at the position at which the side seam of the can body occurs.

FIG. 16 illustrates an embodiment in which the diaphragm 2 is clinched between a flattened bead 21 and an inturned curl 28, FIGS. 16 and 22. The method of securing the diaphragm is illustrated in FIGS. 17 to 23. As above, the flange 16 is formed at position B, the bead 21 is formed at position C and is flattened at position D. The diaphragm 2 is cut and positioned against the flattened bead at position E, and at positions F and G the end portion of the body is formed into an inturned curl, FIG. 21, and the curl is clinched against the diaphragm. FIG. 23 illustrates the portion of the diaphragm clinched in the region of the can body seam which, as above, is located in the groove 23A in the end face of the dolly.

Figure 24:
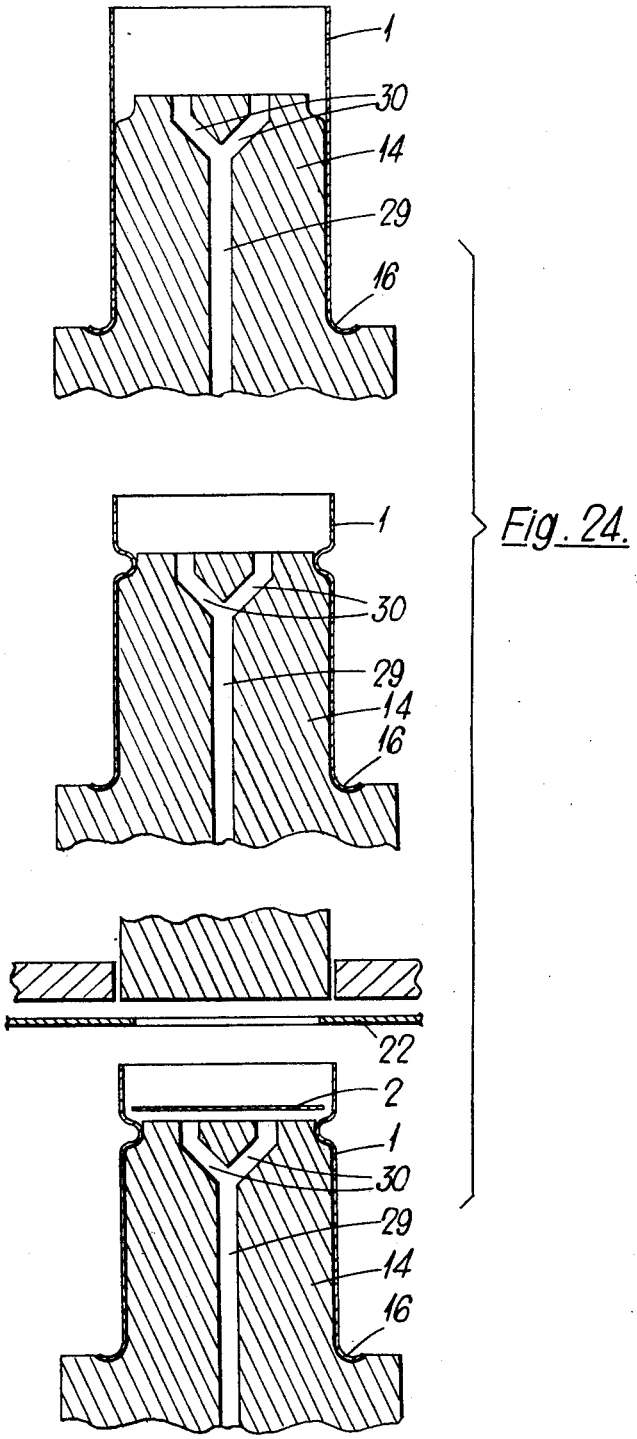
FIG. 24 illustrates modifications to the tooling of FIGS. 18 to 23, FIGS. 25 and 26 illustrate parts of other alternative forms of the can.

FIG. 24 illustrates a dolly 14 provided with passages 29, 30 through which negative air pressure can be applied to the diaphragm to hold it in position while the turret is indexed from position E through position F to position G, the negative air pressure being released after clinching is complete. It is to be understood that this means of holding the diaphragm pending clinching can be used in any of the methods of securing the diaphragm. Positive air pressure can be applied at position H to assist removal of the can from the dolly.

Figure 25:
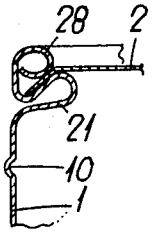

FIG. 25 illustrates a modification in which the diaphragm is clinched between an inturned curl 28 and a bead 21 which slopes upwards towards the curl from the outer side of the body so that the marginal portion of the diaphragm slopes downwards from the inturned curl.

Figure 26:
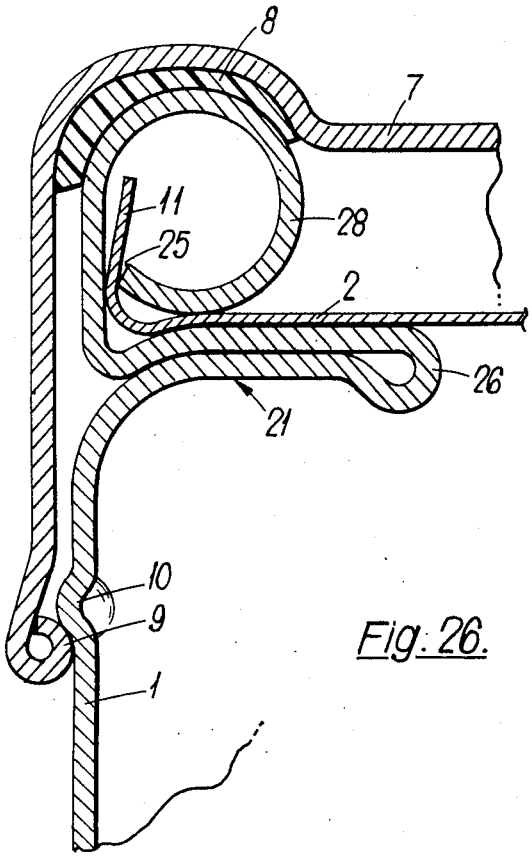
Figure 27:
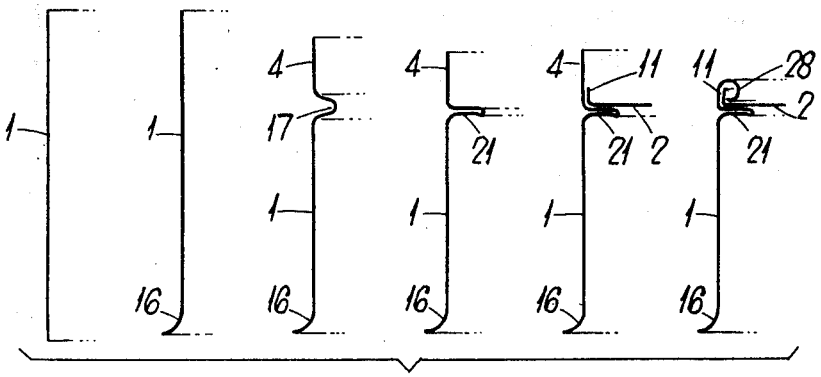
FIG. 27 is a diagram illustrating the steps of the method of forming the can of FIG. 26, FIGS. 28 to 30 illustrate, to an enlarged scale, modifications to the cans.

FIG. 26 illustrates an alternative construction in which the marginal portion 11 of the diaphragm extends into the inturned curl 28 and is nipped between the raw edge 25 of the curl and the body in addition to the diaphragm being clinched between the flattened bead 21 and the inturned curl 28. FIG. 27 illustrates the method of securing the diaphragm in this embodiment and it is thought that following the description given above FIG. 27 is self-explanatory, it being understood that the marginal portion 11 of the diaphragm is nipped against the body during formation of the curl 28.

Figure 28:
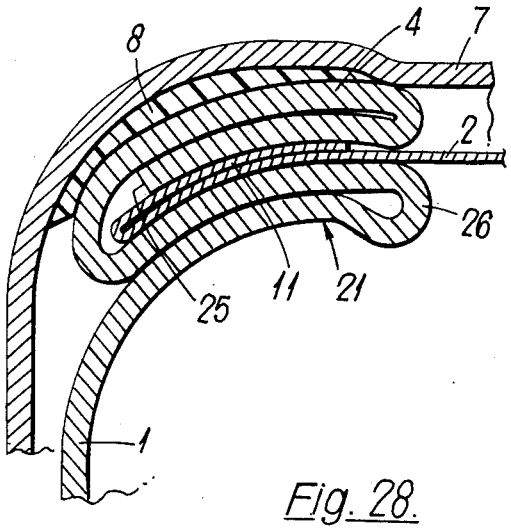
Figure 29:
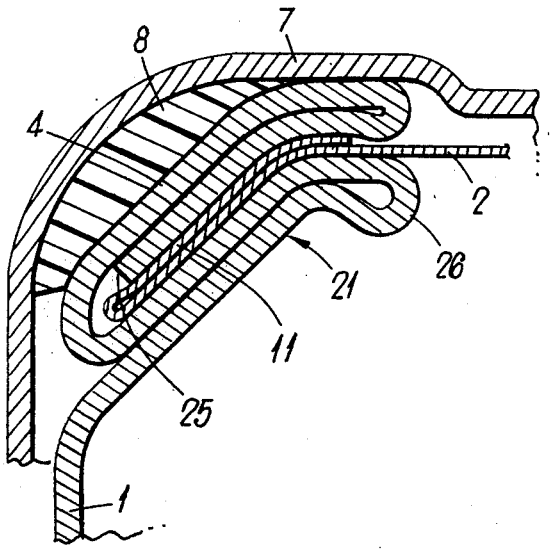
Figure 30:
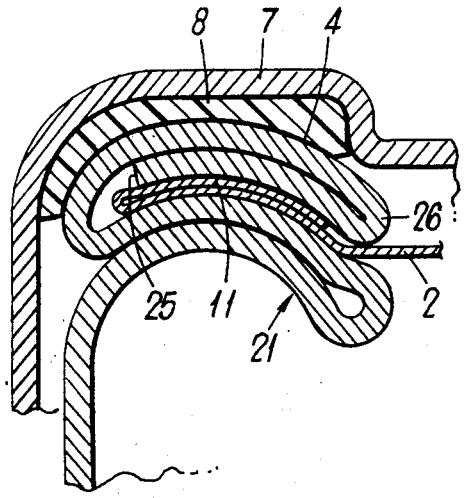

FIGS. 28 to 30 illustrate how any of the kinds of clinching can be deformed after clinching respectively to give thereto a form radiused towards the interior of the body, a form bevelled towards the interior of the body, and a form torroidal towards the interior of the body.

Figure 31:
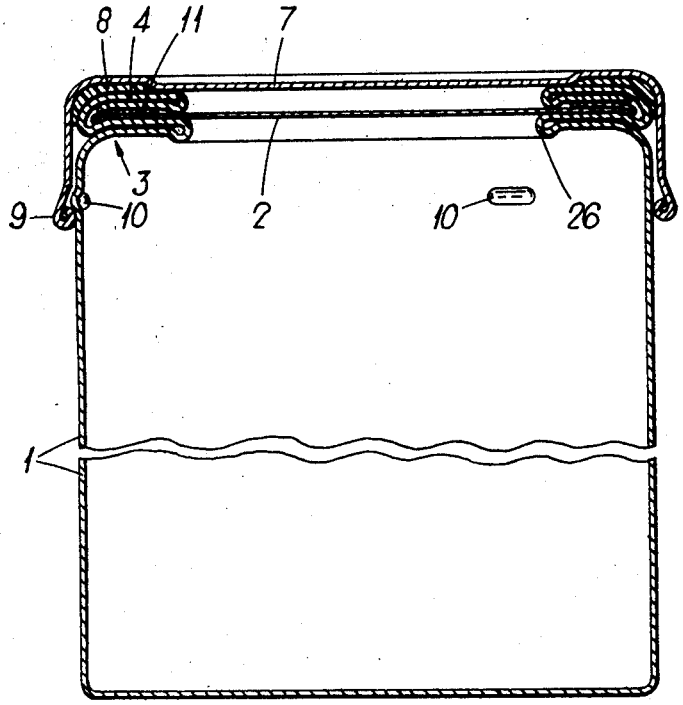
FIG. 31 illustrates a can accordingly to the invention in which the can body is a drawn body.

FIG. 31 illustrates an embodiment of the invention in which the diaphragm closes the open end of a drawn body 31. With a drawn body the diaphragm can be secured in position in any of the ways described above but the ways described with reference to FIGS. 12 and 14 are preferred.

I claim:

1. Apparatus for forming a can body having an inwardly directed overfolded flattened peripherally extending bead comprising a mandrel adapted to receive in external telescopic relationship thereto a longitudinally seamed can body having an inwardly directed overfolded peripherally extending bead, said mandrel including an end wall in axially opposed relationship to an overfolded bead of a can body in external telescopic relationship with said mandrel, recess means in said end wall for receiving a seamed overfolded portion of a can body, means cooperative with said mandrel end wall for flattening an overfolded bead of an associated can body and being additionally cooperative with said recess means for moving the overfolded seamed portion into said recess means whereby a surface of said flattened bead adapted to receive a diaphragm lies in a common plane and axially extending recess means in said mandrel for receiving a remaining seamed portion of an associated can body.

2. The apparatus as defined in claim 1 including a plurality of said mandrels carried by a turret.

3. The apparatus as defined in claim 1 including circumferentially extending recess means opening axially of said end wall and being inboard of said first-mentioned recess means for receiving an inboardmost peripheral edge portion of an associated bead

4. The apparatus defined in claim 1 including circumferentially extending recess means opening axially of said end wall and being inboard of said first-mentioned recess means for receiving an inboardmost peripheral edge portion of an associated bead, first-mentioned and circumferentially extending recess means are in communication with each other, and each of said first-mentioned and circumferentially extending recess means have a bottom wall below the level of said mandrel end wall.

5. The apparatus as defined in claim 1 including a plurality of said mandrels carried by a turret.

6. A method of forming a can body having an inwardly directed overfolded flattened peripherally extending bead comprising the steps of providing a mandrel including an end wall through which axially opens a recess, positioning a longitudinally seamed can body in external telescopic relationship to the mandrel with the seam thereof aligned with the recess, folding the can body to form an inwardly directed overfolded peripherally extending bead, flattening the bead against the end wall by applying a force against the bead and directed toward the end wall, housing a portion of the seam within the recess upon the flattening of the bead thereby forming a substantially flat upper surfaced flattened bead, said mandrel further includes an axial slot aligned with the recess and including the further step of positioning another portion of the can body seam in the axial slot prior to performing the flattening step.

7. The method as defined in claim 6 wherein the can body seam is an internal seam which projects radially inwardly beyond the nominal internal diameter of the can body.

8. The method as defined in claim 6 including the step of placing a diaphragm upon the flattened bead, and folding a terminal end portion of the can body upon a periphery of the diaphragm to grip the latter between the flattened bead and folded terminal end portion.

* * * * *